US008313001B1

(12) United States Patent
Reid et al.

(10) Patent No.: US 8,313,001 B1
(45) Date of Patent: Nov. 20, 2012

(54) CONTAINER CLOSURE WITH STORED SCOOP

(75) Inventors: Grahame W. Reid, Novato, CA (US); Donald Waring, Rohnert Park, CA (US); David Lloyd, Santa Rosa, CA (US)

(73) Assignee: Innovative Molding, Rohnert Park, CA (US)

( * ) Notice: Subject to any disclaimer, the term of this patent is extended or adjusted under 35 U.S.C. 154(b) by 910 days.

(21) Appl. No.: 12/322,175

(22) Filed: Jan. 28, 2009

(51) Int. Cl.
*B65D 41/56* (2006.01)

(52) U.S. Cl. ..... 220/212; 220/256.1; 220/574.1; 220/735; 215/228

(58) Field of Classification Search ..... 220/212, 220/255, 256.1, 359.1, 574.1, 212.5, 735; 215/228, 232; 426/115, 132; 206/223, 541, 206/542
See application file for complete search history.

(56) References Cited

U.S. PATENT DOCUMENTS

| | | | | |
|---|---|---|---|---|
| 3,550,805 | A | 12/1970 | Leonforte | |
| 3,624,787 | A | 11/1971 | Newman | |
| 3,679,093 | A | 7/1972 | Chang | |
| 4,095,716 | A | 6/1978 | Meany | |
| 4,216,875 | A | 8/1980 | Stanish | |
| 4,432,466 | A | 2/1984 | Allen | |
| 4,990,345 | A | 2/1991 | Webb | |
| 5,005,719 | A * | 4/1991 | Phillips et al. | 215/230 |
| 5,090,572 | A | 2/1992 | DeRoseau | |
| 5,251,758 | A | 10/1993 | Kolacek | |
| 5,415,309 | A | 5/1995 | Wang | |
| 5,647,413 | A | 7/1997 | Horrell | |
| 5,695,084 | A | 12/1997 | Chmela et al. | |
| 5,705,212 | A | 1/1998 | Atkinson | |
| 5,706,974 | A | 1/1998 | Murdick et al. | |
| 5,947,289 | A * | 9/1999 | Stridsberg et al. | 206/446 |
| 6,003,710 | A * | 12/1999 | Huang | 220/212 |
| 6,604,645 | B1 * | 8/2003 | Vaupotic | 220/212 |
| 6,604,646 | B2 * | 8/2003 | Torniainen et al. | 220/212 |
| 7,175,041 | B2 | 2/2007 | Ekkert | |
| D572,538 | S | 7/2008 | Epstein et al. | |
| D576,035 | S | 9/2008 | Perry et al. | |
| D578,401 | S | 10/2008 | Perry et al. | |
| 2001/0033882 | A1 | 10/2001 | Liu | |
| 2004/0094548 | A1 * | 5/2004 | Laveault | 220/212 |
| 2008/0093366 | A1 | 4/2008 | McKahan et al. | |
| 2008/0156808 | A1 | 7/2008 | Perry et al. | |
| 2009/0184120 | A1 | 7/2009 | Stevens | |
| 2011/0174817 | A1 | 7/2011 | Blomdahl et al. | |

FOREIGN PATENT DOCUMENTS

| | | |
|---|---|---|
| GB | 2250271 | 6/1992 |
| JP | 2000107052 | 4/2000 |
| JP | 2000287807 | 10/2000 |
| JP | 2004315068 | 11/2004 |
| JP | 2007137510 | 6/2007 |

* cited by examiner

*Primary Examiner* — Mickey Yu
*Assistant Examiner* — Kareen Rush
(74) *Attorney, Agent, or Firm* — Woodard Emhardt Moriarty McNett & Henry LLP

(57) ABSTRACT

A container with a granulated or powdered product stores a scoop in or on a threaded closure for the container, in such a way that the scoop will not sink down into the product. Several embodiments are disclosed, including different ways for retaining the scoop on the closure.

15 Claims, 10 Drawing Sheets

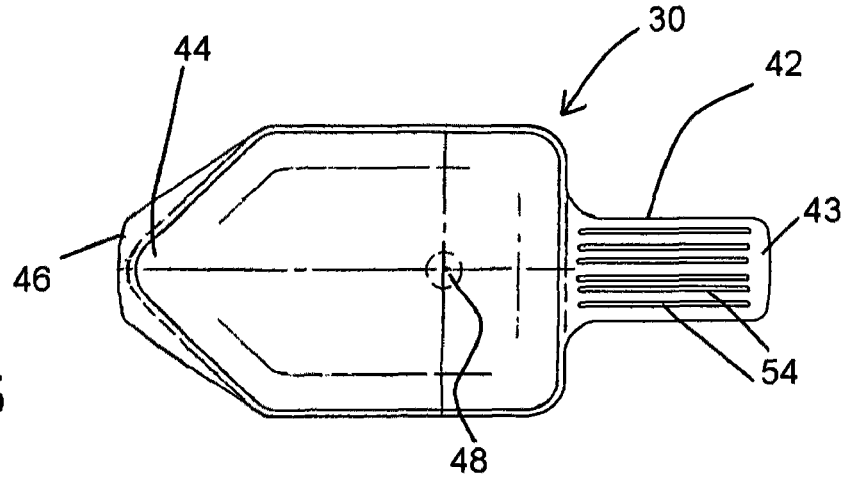
FIG. 5
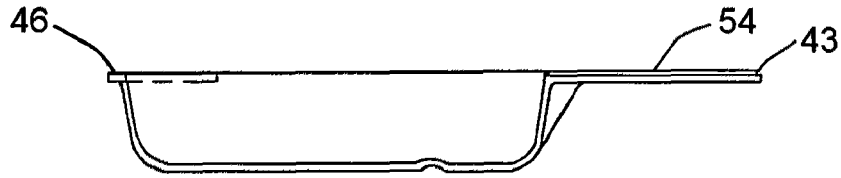
FIG. 5A
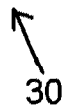

CONTAINER CLOSURE WITH STORED SCOOP

BACKGROUND OF THE INVENTION

The invention concerns containers for various products, and in particular relates to containers with molded plastic, threaded closures for products such as powdered concentrates that require a scoop.

Protein powders, weight gain formulas, weight loss formulas, vitamin and mineral supplement powders and similar products are usually sold in containers with plastic threaded closures. These are often relatively large-mouth containers, often 110 mm or 120 mm in diameter. Powdered products that are for mixing by the consumer into water or other liquid beverages often are sold with a scoop, a simple plastic device placed directly in the container with the powdered product. Even if placed on the top surface of the powdered product, the scoop will work its way down into the powder during shipping, and therefore the consumer must retrieve the scoop by hand, reaching into the powder, which produces a messy and objectionable situation.

There have been some approaches to this problem. In one approach, a powdered baby formula container, non-threaded, had a closure secured to the container in a normal way but the closure had an upper part to house a scoop. For access to the scoop the closure was swung upwardly on a hinge. The powdered contents were sealed into the container, with a liner secured to the upper rim of the non-threaded container. See U.S. Published Application No. 2008/0156808.

A simpler and more efficient way of storing a scoop separate from a powdered or liquid concentrate product is needed, especially for threaded closures and for the case in which products are for human consumption.

In addition to the above published application, the following patents and publications show prior approaches to storing a scoop or utensil in or adjacent to a cap, sometimes to prevent the utensil from being submerged in the contained product: U.S. Pat. Nos. 7,175,041, 5,705,212, 5,415,309, 5,090,572, 4,216,875, 3,679,093, 3,624,787, D572,538, U.S. pub. No. 2008/0093366, Japan pub. app. Nos. 2007-137510, 2004-315068, 2000-287807, 2000-107052 and Great Britain pub. app. No. 2 250 271.

Of the above patents and publications, U.S. Pat. Nos. 5,705,212 and 7,175,041 show storage and retention of a utensil or scoop within some form of cap. In the former the utensil is in a snapped-on, non-threaded overcap; in the latter the scoop is held up against the top panel inside a deep threaded cap.

SUMMARY OF THE INVENTION

In several embodiments of this invention a scoop is retained to or by a threaded container closure so as not to be submerged in the product. In one form of the invention, the scoop is held in an overcap which fits nestingly together on the top of a normal threaded container closure. The unthreaded overcap is retained to the regular cap in an appropriate manner such as by a shrink-fitted plastic band retained in sealed engagement around the exterior joint between the two caps. The scoop may be retained loosely in the overcap, or it may be fitted closely within the overcap such that little or no movement is permitted, or it may be firmly retained by a novel retention system.

In another form of the invention the overcap simply comprises a raised, smaller-diameter portion of a unitary molded cap. An internal shoulder can be provided just below the raised portion for engagement down against the container finish of the threaded cap. If a liner is to be used this can be secured to the container finish prior to installation of the cap.

In another form, the invention places the plastic scoop directly inside the container and up against the liner, which is initially assembled into the cap. For example, the scoop can be held in place on the liner by a glue dot, until removed by the consumer.

In all cases of a granulated or powdered product, the consumer, after opening the container, can simply place the scoop on the top surface of the powder between uses. The problem of objectionable sinking down into the powder occurs only during shipment.

It is therefore among the objects of the invention to conveniently store a scoop of the type used for powder or liquid concentrates in or on a closure for a container of the product, in such a way that the scoop will not sink down into the product. These and other objects, advantages and features of the invention will be apparent from the following description of a preferred embodiment, considered along with the accompanying drawings.

DESCRIPTION OF THE DRAWINGS

FIG. 5 is a plan view showing a scoop to be contained in the closure of FIGS. 1-4.

FIG. 5A is a side elevational view in section showing the scoop.

DESCRIPTION OF PREFERRED EMBODIMENTS

Figure 1:
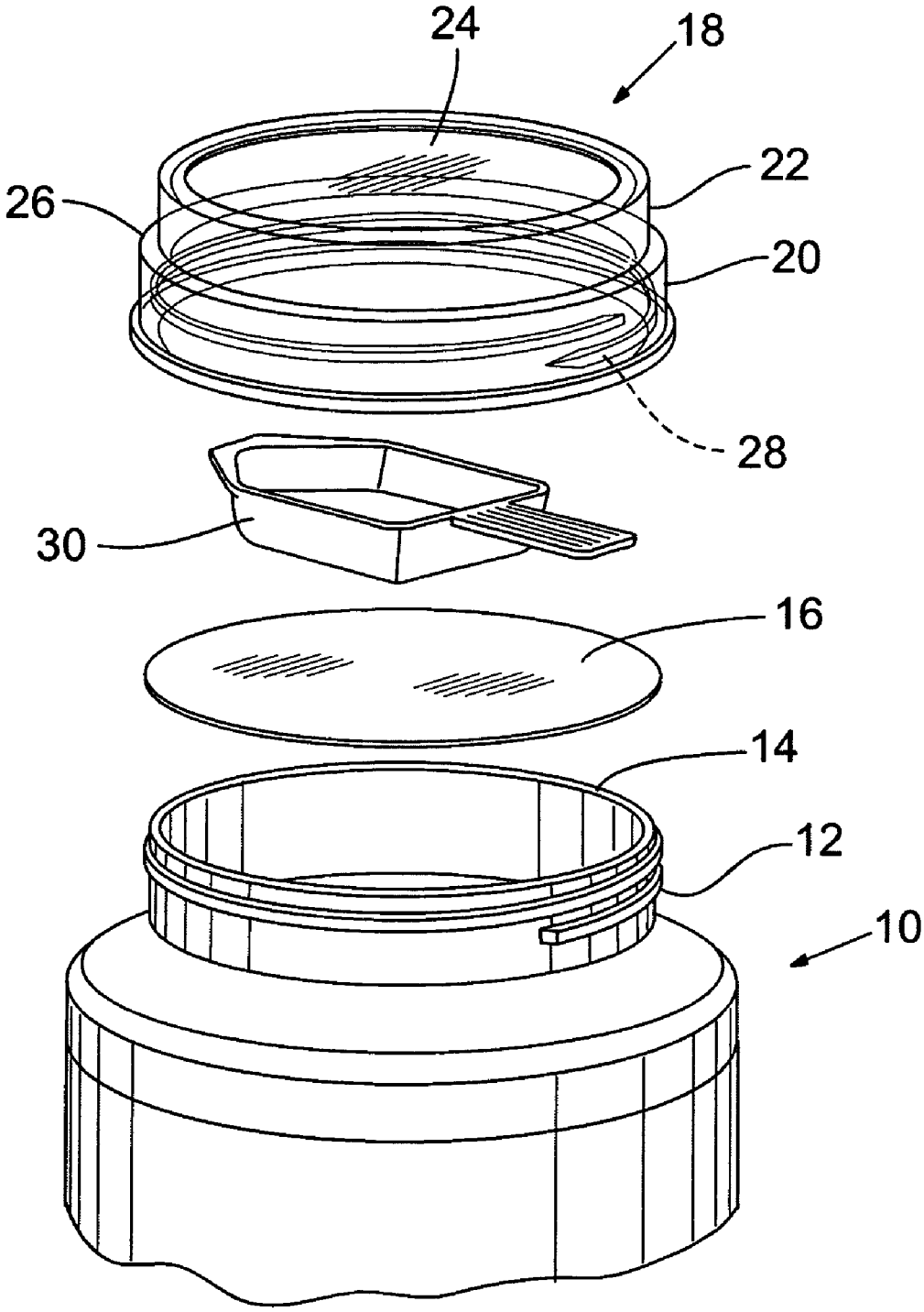
FIG. 1 is an exploded view in perspective showing one embodiment of a threaded container closure with a scoop retained in the closure separate from the granular or powdered contents of the container.

In the drawings, FIG. 1 shows in exploded view a container 10 having a threaded neck 12, the container being of the type, usually of injection-molded plastic, for containing powdered or granulated products for human consumption, such as protein powders, weight gain formulas, weight loss formulas, etc. These are usually large, wide mouth containers, for example with 110 or 120 mm container finish 14, sometimes holding a gallon of product.

In this embodiment a sealing liner 16 may be secured to the container finish 14, typically by conductive heating, i.e. a heated platen engaging the circular liner 16 down against the container finish 14. In this case the liner is added prior to any closure being attached to the container. As an alternative the liner can be pre-assembled into the cap and later inductively sealed, as explained below.

The drawing shows a threaded closure 18, having lower and upper skirt parts at 20 and 22 and with a top panel 24 extending across the upper end of the upper skirt part 22. The upper skirt part 22 is smaller in diameter than the lower skirt part 20, this difference in diameter being sufficient to enable the container finish to seal. A generally horizontal ledge 26 connects the smaller upper skirt part 22 with the larger lower skirt part 20, providing the seal for the container finish. An internal thread or threads 28 are seen on the inner side of the threaded closure device 18, which preferably is substantially (or at least generally) transparent. The closure device 18 is preferably injection-molded as a single common integral piece.

A scoop 30 is also shown in FIG. 1, in an upright orientation in this embodiment, to be fitted into the space defined in the interior of the upper portion of the closure 18, defined by the upper skirt part 22. This scoop in one preferred embodiment is retained firmly against the inside of the top panel 24, and it resides between the top panel 24 and the liner 16 which is fixed to the container finish 14. The scoop could be in an inverted orientation, as it is in FIG. 12 explained below. The closure 18 is screwed onto the container neck 12 with the scoop held securely inside the closure.

Figure 2:
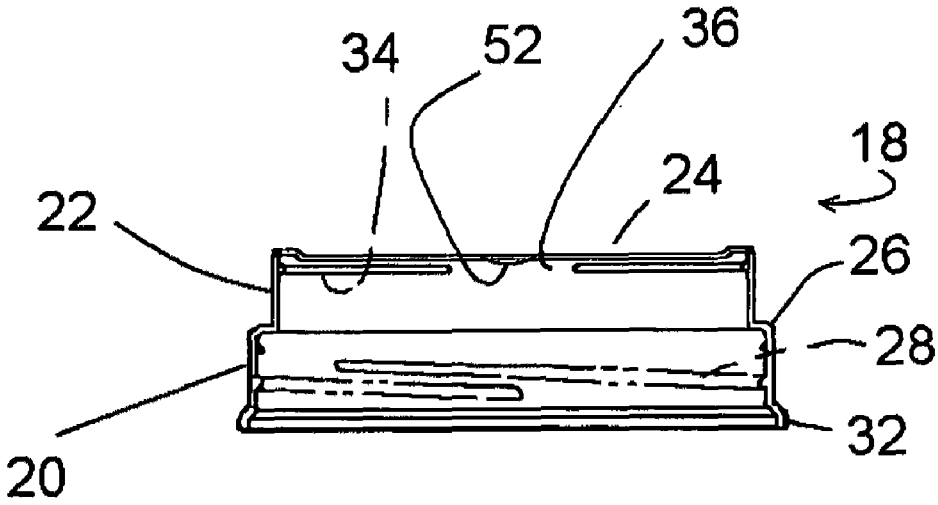
FIG. 2 is an elevation view in cross section showing the container closure.
Figure 3:
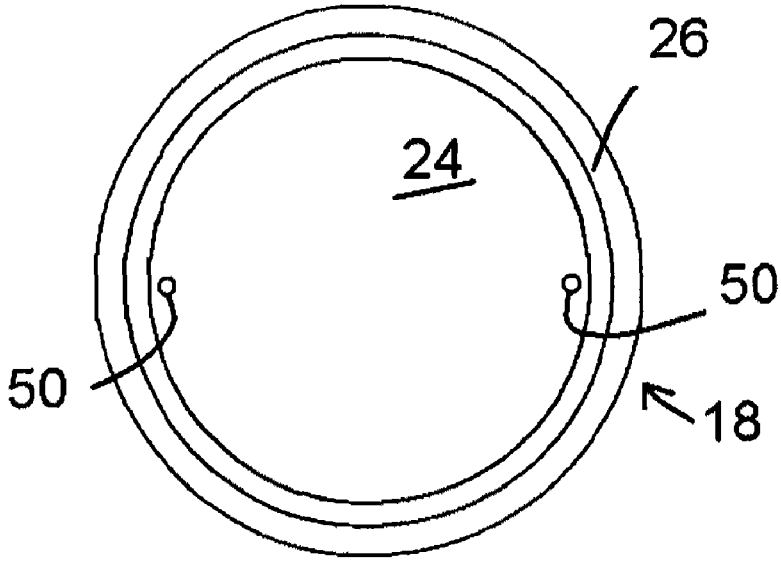
FIG. 3 is a bottom plan view showing the closure.
Figure 4:
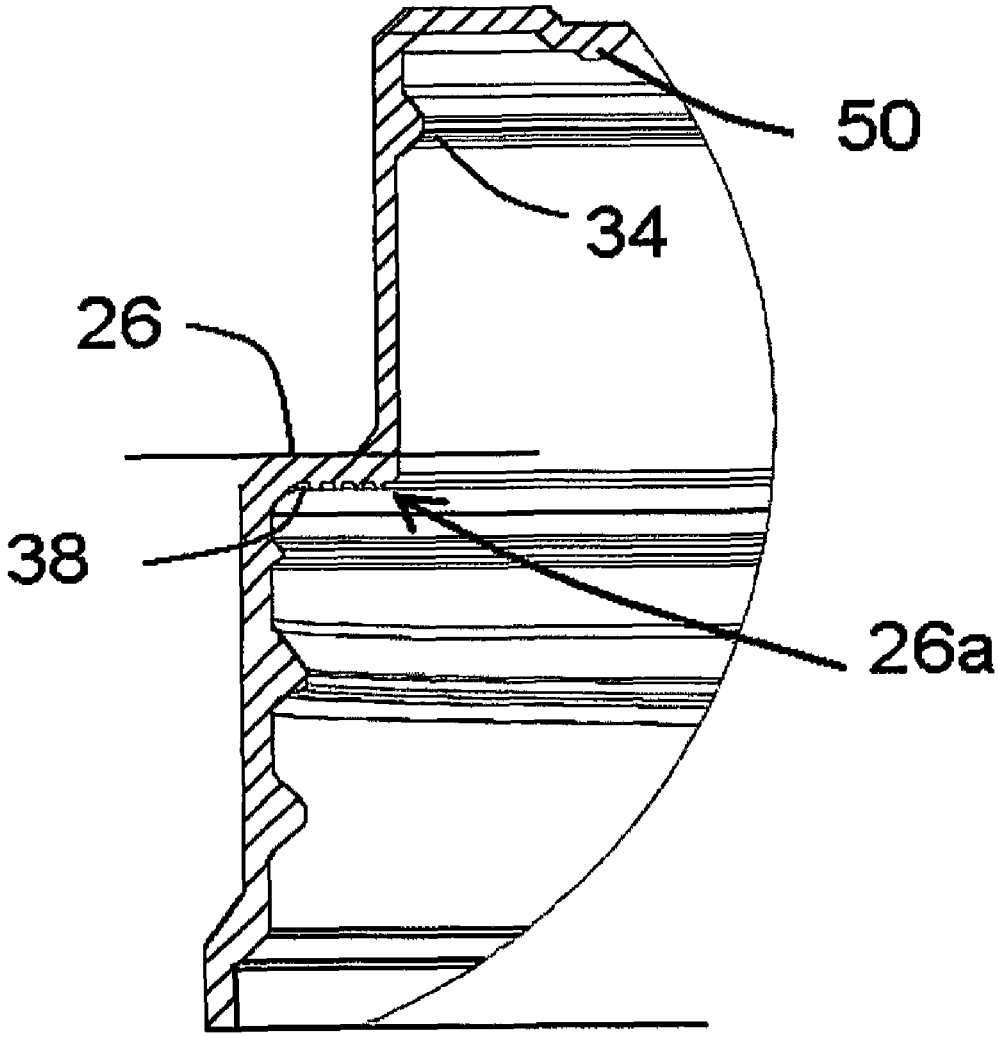
FIG. 4 is an enlarged and fragmented sectional view showing a portion of the closure.

FIGS. 2 and 3 illustrate the threaded closure 18 in sectional elevation and in interior plan view. FIG. 4 is a fragmented sectional view showing details of the closure. FIG. 2 shows the lower skirt part 20 formed with the internal thread 28 and having an increased-diameter outwardly extending lip 32, which is consistent with other large-diameter injection-molded caps of the applicant/assignee for stacking. FIG. 2 also reveals an internal ridge or bead 34 formed in the upper skirt part 22, below the surface of the top panel 24. The bead 34 is seen in better detail, in cross section, in FIG. 4. As shown in FIG. 2, this bead is interrupted at an interruption 36, which may be an approximately 1" gap, or in any event sufficient to receive a scoop as discussed below. This occurs at two 180°-opposed locations. The purpose of this bead is to retain a scoop, discussed below with reference to FIGS. 5 and 5A, in "bayonet" locking fashion up against the bottom of the top panel 24. In FIG. 4 this bead 34 is seen as having sloped surfaces at top and bottom, primarily to enable stripping from the mold.

A modified retention band is discussed below with reference to FIG. 10.

FIG. 4 also shows the inward step 26 in the diameter of the closure 18, providing an internal ledge 26*a* for the closure to engage against the container finish. The reduction in diameter, in one example for a 120 mm closure, is from about 4.7" internal diameter just below the ledge to about 4.37" internal diameter just above the ledge, thus a difference of 0.36", or about ⅜". This provides about 3/16" radius difference, so that the ledge internally is about 3/16", providing an adequate distance for engaging against the container finish. This ledge width can vary. Preferably a series of induction sealing rings 38 are included on the ledge, as shown, and the ledge should be wide enough to allow at least two of the rings 38 to engage against the container finish. A liner can be assembled into the closure 18 against this ledge, then inductively heated and sealed onto the bottle finish after the closure is screwed tightly onto the bottle. These will engage down against the liner 16 (FIG. 1), which will already have been secured to the container finish.

One form of the scoop 30 is shown in FIGS. 5 and 5A. It is configured especially for being contained in and secured in the closure 18. As shown in the drawings, the scoop has a handle 42 with an end 43, and at the opposite end of the scoop, i.e. the pouring end 44, is a tip flange 46 that extends forward by a small distance, about 1/32" to 1/16", as best seen in FIG. 5A. These two ends of the scoop, the back end 43 of the handle and the tip flange 46, are essentially coplanar and at the top of the scoop. Both of these edges 46 and 43 preferably have a curvature as shown, which follows a radius from a central point 48 between them and on a median line longitudinally through the cup. This provides for the cup to be "bayonet" mounted into the closure 18. The tip flange 46 and handle 43, each of which may be about 0.045" in thickness, are configured to be inserted in the upper part of the closure 18 which is seen in FIGS. 2, 3 and 4, between respective arcs of the bead 34 and the top panel 24 above. FIG. 4, at the top of the drawing, shows this insertion position in some detail. The vertical distance a shown in FIG. 4, between a downwardly protruding bump or nipple 50 on the top panel and the start of the top ramp of the bead 34, is essentially the same as the thickness of the tip flange 46 and the back end 43 of the handle of the scoop, i.e. about 0.045" to 0.050". The bump 50, of which there are two at 180°-opposed positions, is also shown in the bottom plan view of FIG. 3. A central bump 52 extending down at the center of the top panel, seen in FIGS. 2 and 4, is a gate well for injection molding. When the scoop is assembled into the cap 18, it is brought up into the cap in a position generally as shown in FIG. 1, with the handle end 43 and the tip flange 46 positioned in the two interruptions 36 between bead segments 34. This puts the two tips at both ends of the scoop in position to slide above the bead segments 34 when the scoop is rotated. The two opposed nipples or bumps 50, when reached by the two ends of the scoop, provide a close fit and require that the remaining rotation of the scoop into place be in forced rotation such that the scoop is held tightly in place. In fact, the scoop handle 42 preferably has a series of parallel ridges 54, seen in FIGS. 5 and 5A, which will snap or click against the nipple 50 as the scoop is rotated into its final position, providing a tactile and audible feedback.

Figure 6:
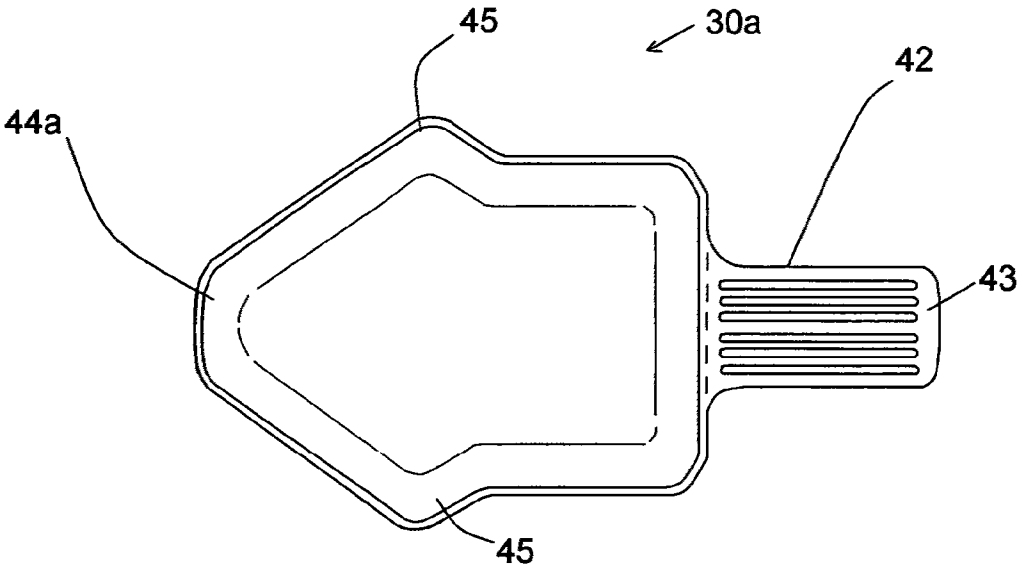
FIG. 6 is a plan view similar to FIG. 5 but showing a different form of scoop.
Figure 6A:
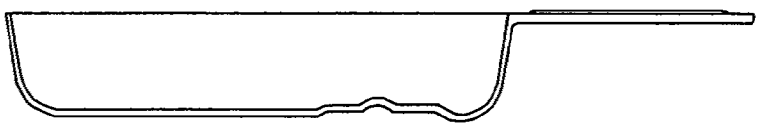
FIG. 6A is a side elevational view in section showing the scoop of FIG. 6.
Figure 6B:
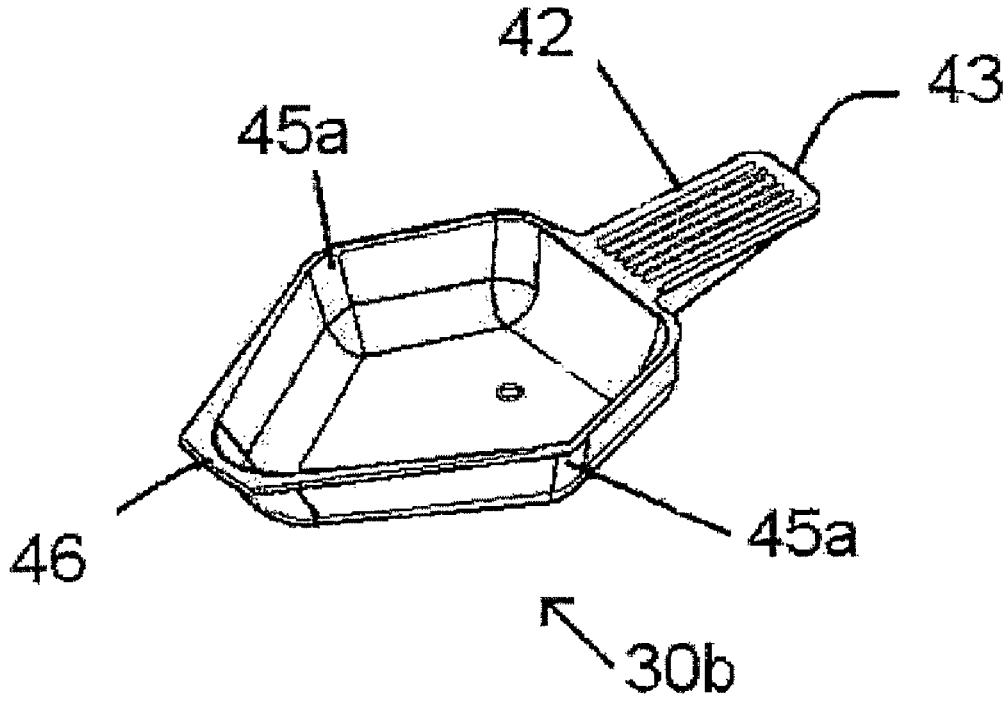
FIG. 6B is a perspective view showing a scoop similar to but slightly modified from that of FIG. 6.
Figure 6D:
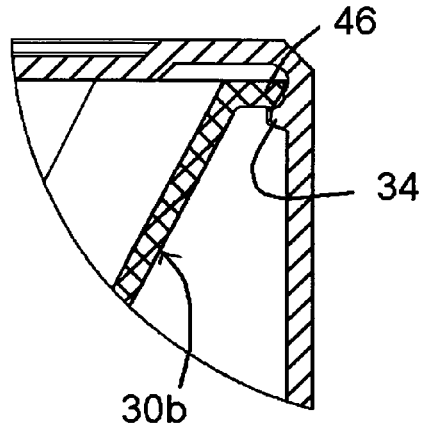
FIG. 6D is a detail view in elevational cross section showing engagement of the scoop of FIG. 6B within the cap or overcap.
Figure 12:
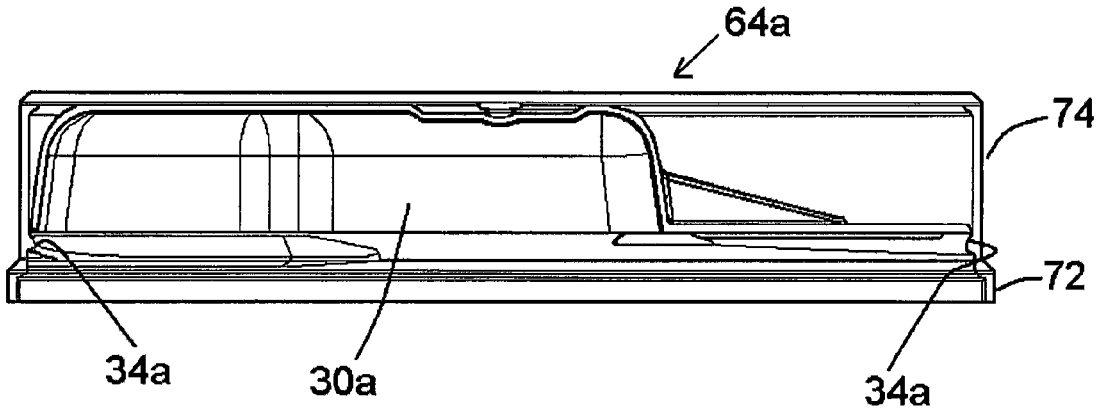
FIG. 12 is a cross section view showing a scoop retained in the overcap of FIGS. 10 and 11.

FIGS. 6 through 6D show modified forms of the scoop 30. FIG. 6 shows a modified scoop 30*a* having, in addition to a front pour spout 44*a*, side pour spouts 45 at each side, for convenience to the user in dispensing controlled amounts of a powder or granular product. The handle 42 is similar to that of FIGS. 5 and 6, and the scoop is generally similar to that other embodiment except in regard to the side pour spouts. In this form of scoop 30*a*, there is no tip flange such as the tip flange 46 shown in FIGS. 5 and 6; this scoop can be retained inverted as shown in FIG. 12 and explained below.

FIG. 6B shows a somewhat different form of scoop 30*b*, with a simpler parameter that includes side pour spouts 45*a*, and with a tip flange 46 as in the first-described embodiment.

Figure 6C:
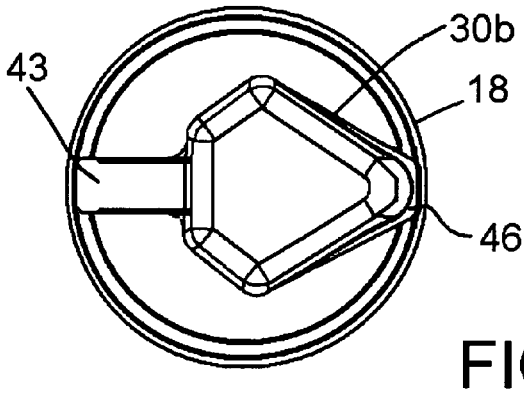
FIG. 6C is a bottom plan view showing the scoop of FIG. 6B retained in a cap or overcap.

FIG. 6C shows the scoop 30*b* as secured in a closure or overcap, which could be the top portion of the closure 18 shown in FIG. 2 or an overcap as described below with reference to FIGS. 7-9. The scoop is retained in bayonet style by engaging the handle end 43 and the tip flange 46 under the arcuate bead 34, as shown in detail in FIG. 6D.

Figure 7:
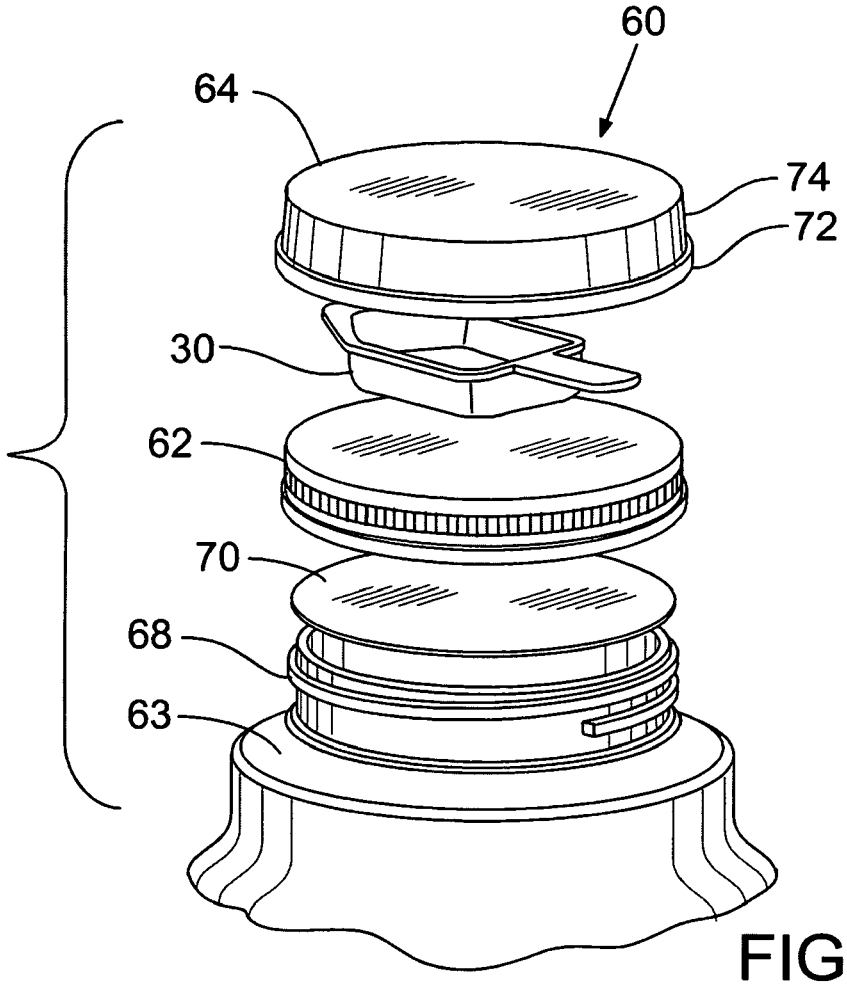
FIG. 7 is an exploded perspective view showing a second embodiment of the invention wherein the scoop is contained in an overcap secured on top of a normal threaded closure.
Figure 8:
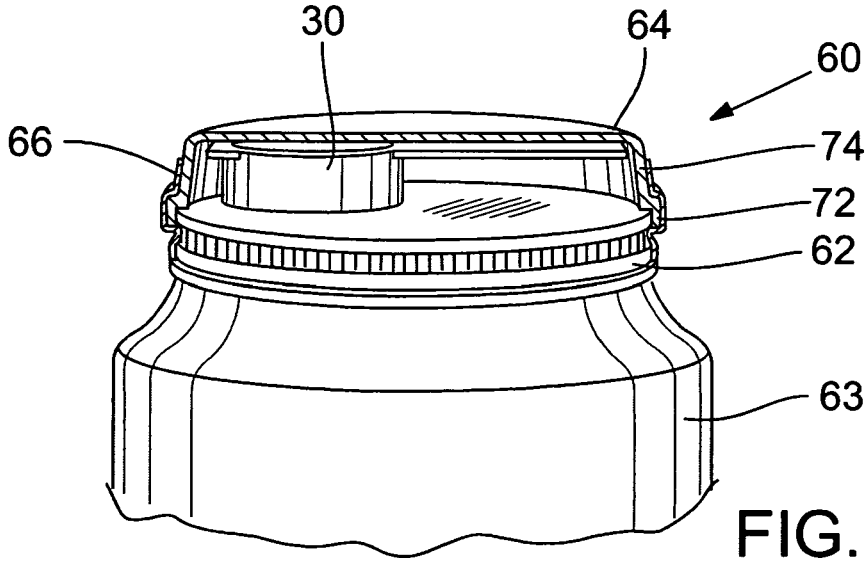
FIG. 8 is a side elevation, slightly perspective view in section showing the closure of FIG. 7.

FIGS. 7 and 8 show another embodiment of the invention, wherein the scoop-containing closure 60 comprises a threaded cap 62 which can be of conventional design, together with an overcap 64 that nests on top of a cap 62, is without threads, and is bonded to the threaded cap 62, preferably by a plastic shrink band 66 (indicated in FIG. 8). The scoop 30, as seen in the other drawings, is contained in the overcap 64. FIG. 8 shows the assembly in cross section. The container closure cap 62 is shown screwed onto the container 63 via threads 68 (FIG. 7) in the conventional way. This cap component is fitted with a liner 70 (FIG. 7) in the typical manner, the liner being compressed down against the container finish when the cap is screwed onto the container, then inductively heated to bond the liner to the top of the container finish. The overcap 64 is shown assembled onto the top of the basic cap 62, in nested relationship via an expanded-diameter annular skirt portion 72 at the bottom end of the overcap's skirt 74. This annular recess formed by the skirt tail 72 is of a size to engage closely over the top shoulder of the basic cap 62, and the feature is known in the industry as a feature of the assignee of this invention, for nesting newly manufactured injection-molded, large-diameter caps together into "logs" for dimensional stability of the caps and for dense packing into cartons. The feature is known as TAPERSTACK on caps, produced by Innovative Molding, Inc. of Sebastopol, Calif. (the assignee herein).

The scoop 30, which can be the same scoop as shown in FIGS. 5 and 5A, is secured in the overcap 64, and may be held therein by the same quick "bayonet" type mounting described above, or by a modified retention described below in reference to FIG. 10. Alternatively, the scoop 30 could simply be retained in the overcap by a glue dot of the type that is easily releasable by the consumer, or the scoop could be dimensioned to be very closely held within the internal diameter of the overcap 64, without the bayonet mounting. The shrink band 66 is of the kind used commonly to provide a seal over the joint between a cap and a container. The plastic band is held in place and heated to cause shrinking of its diameter to tightly grip the overcap 64 and the regular cap 62 across the joint between them, providing an effective seal.

Figure 9:
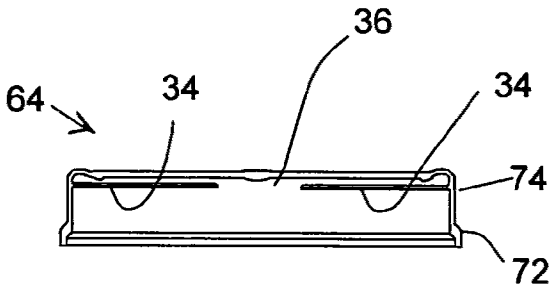
FIG. 9 is an elevation view in section showing the overcap of FIGS. 7 and 8.

FIG. 9 shows the overcap 64 in cross section, showing the same bayonet mounting structure as shown in the upper cap part 22 in the embodiment shown in FIGS. 1-4. The difference here is that the overcap has essentially the same internal diameter as the basic cap 62 so that the scoop can be of greater length, the difference being dictated by the dimension of the internal ledge 26*a* between the upper and lower sections of the first embodiment, best seen in FIG. 4. The arcuate retention beads are shown at 34, and one of the interruptions between them shown at 36.

Figure 10:
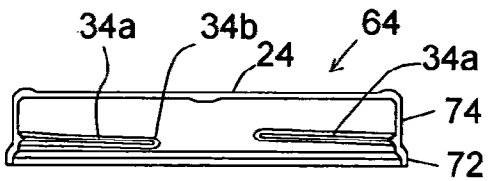
FIG. 10 is a elevation view in section showing an overcap similar to that of FIGS. 7-9 but with a modified form of scoop retention.

FIG. 10 shows a variation in an overcap 64*a* for retention of a scoop, and this applies equally to the upper skirt part 22 of the first-described closure device 18, as shown in FIG. 2. Here, the arcuate retention bead of the cap 18 is replaced by a helical bead 34*a*, which acts as essentially as an internal thread, but not for use in securing the overcap 64*a* to a container. The helical bead or thread 34*a* preferably comprises two separate internal threads with thread starts 180° apart. The thread starts are at the same level, and one thread start 34*b* is visible in the sectional view of FIG. 10, while the right side of the drawing shows the end of a different and opposing thread section.

These helical beads or threads enable a scoop such as described above to be assembled into the overcap by screwing the scoop into position. FIG. 12 illustrates a scoop being retained in the overcap 64*a*. In this case the scoop is inserted into the overcap with the open upper side of the scoop downward, i.e. with the open side of the scoop facing in the same direction as the opening of the overcap. The scoop can be similar to the scoop 30*a* of FIGS. 6 and 6A, without a tip flange on the front pour spout 44*a*, since the scoop is inverted. The depth of the scoop is such that the scoop can be engaged onto the thread sections 34*a* via the front pour spout edge 44*a* and the handle end 43 as shown in the scoop drawings. One of the scoop designs with a tip flange 46 could be used if desired. The depth of the scoop, and the positioning of the thread sections 34*a*, can be such that the pan of the scoop engages up against the top panel 24 of the overcap, or there can be a clearance between the scoop and the top panel as shown in FIG. 12. The length of the scoop can be such that, in combination with a slight taper of the overcap (narrower diameter toward the top panel), the handle and tip flange engage or wedge tightly against the internal surface of the overcap skirt, thus firmly holding the scoop in position without requiring engagement against the underside of the top panel.

Figure 11:
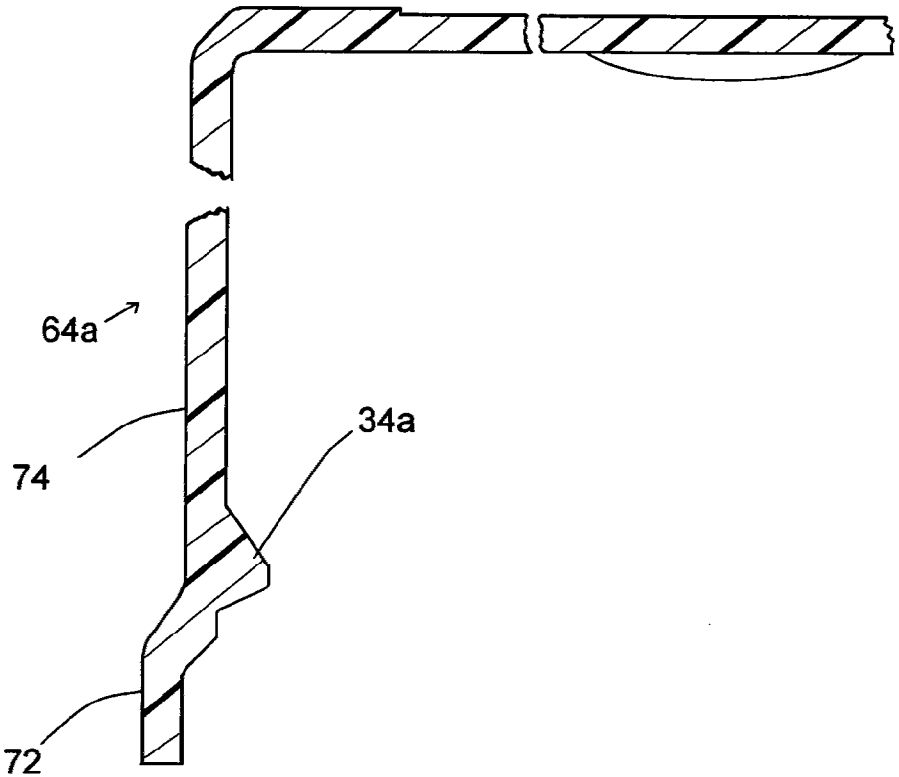
FIG. 11 is an enlarged detail view showing a portion of the overcap of FIG. 10.

FIG. 11 shows in detail one of the bead or thread sections 34*a* on the inside surface of the overcap 64*a*, just above the expanded-diameter annular skirt portion 72 as described above.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A threaded closure assembly for a container, accompanied by a scoop for a product enclosed within the container, comprising:

an injection-molded threaded closure having a generally cylindrical skirt depending from a top panel of the closure, with internal threads formed on the skirt, and a liner positioned in the closure against an inside surface of the top panel, an overcap of injection-molded plastic, generally similar in shape to the threaded closure but without threads, the overcap having an overcap top panel and a generally cylindrical overcap skirt depending from the overcap top panel, the overcap skirt having an annular lip of increased diameter extending down at a bottom of the overcap skirt, the lip being closely fitted over a top of the threaded closure, a scoop contained within the overcap, in a space defined between the overcap top panel and the top panel of the threaded closure when the overcap is fitted over and nested together with the threaded closure, with means for retaining the scoop firmly in the space, and an annular shrink band extending around the overcap and threaded closure and covering a joint between the overcap and threaded closure and sealing the space within the overcap.

2. The assembly of claim 1, wherein the overcap is of substantially transparent plastic material, revealing the scoop inside.

3. The assembly of claim 1, wherein the means for retaining the scoop comprises a bead formed on the inside surface of the overcap skirt, the bead being in two helical sections at 180°-opposed positions, acting as opposed helical threads, the scoop having a handle and a tip flange at opposite ends of the scoop, the handle and tip flange defining span of a length generally the same as the inside diameter of the overcap skirt, whereby the scoop can be inserted into the overcap with the scoop's handle and tip flange being positioned at thread starts of the two helical threads, then the scoop can be rotated relative to the overcap to effectively screw the scoop up into the overcap so as to firmly retain the scoop within the closure.

4. The assembly of claim 3, wherein the overcap skirt is slightly tapered to smaller diameter toward the overcap top panel, such that the scoop wedges tightly into a locked position as it is screwed in along the threads.

5. The assembly of claim 1, wherein the means for retaining the scoop comprises a bead formed on the inside surface of the overcap skirt, the bead being formed in at least two arcuate segments with interruptions between the segments, and the scoop having a handle and a tip flange at opposite ends of the scoop, the handle and tip flange defining span of just slightly less length than the inside diameter of the overcap skirt, whereby the scoop can be inserted into the closure up against the top panel with the scoop's handle and tip flange being positioned at interruptions between the two arcuate bead segments, then the scoop can be rotated relative to the closure to firmly engage the end of the handle and the tip flange between the bead and the overcap top panel so as to firmly retain the scoop within the closure assembly.

6. The assembly of claim 5, further including a series of ridges on the upper surface of the scoop's handle, and a protruding bump on the inside surface of the overcap's top panel positioned to engage in interfering relationship with the ridges when the scoop is placed top upwardly against the overcap top panel and twisted into position to be retained between the bead and the overcap top panel, such that the scoop tangibly and audibly sweeps into proper position in the overcap.

7. A container and threaded closure accompanied by a scoop for a product in the container, comprising:

a container having a generally cylindrical neck with external threads, and a container finish at a top end of the neck;

a liner adhered and sealed to the container finish thus sealing the product within the container;

a threaded closure screwed onto the threaded container neck, the closure having a generally cylindrical lower skirt part with internal threads and with a first skirt diameter, an inwardly extending annular ledge defining an upper end of the lower skirt part and positioned for engagement by the container finish with the liner, and an upper skirt part of a second diameter smaller than the first diameter, with a top panel extending across the top of the upper skirt part;

a scoop contained in the closure, in a space defined between the liner and the top panel, with means for retaining the scoop firmly within the space;

wherein the means for retaining the scoop comprises a bead formed on the inside surface of the upper skirt part, and the scoop having a handle and a tip flange at opposite ends of the scoop, the handle and tip flange defining span of a length approximately the same as the inside diameter of the upper skirt portion and engaged above the bead to retain the scoop in the closure adjacent to the top panel; and wherein the bead is interrupted and formed in at least two arcuate segments, whereby the scoop can be inserted into the closure up against the top panel with the scoop's handle and tip flange being positioned at interruptions between the two arcuate bead segments, then the scoop can be rotated relative to the closure to firmly engage the end of the handle and the tip flange between the bead and the top panel so as to firmly retain the scoop within the closure.

8. A container and threaded closure accompanied by a scoop for a product in the container, comprising:

a container having a generally cylindrical neck with external threads, and a container finish at a top end of the neck;

a liner adhered and sealed to the container finish thus sealing the product within the container;

a threaded closure screwed onto the threaded container neck, the closure having a generally cylindrical lower skirt part with internal threads and with a first skirt diameter, an inwardly extending annular ledge defining an upper end of the lower skirt part and positioned for engagement by the container finish with the liner, and an upper skirt part of a second diameter smaller than the first diameter, with a top panel extending across a top of the upper skirt part;

a scoop contained in the closure, in a space defined between the liner and the top panel, with means for retaining the scoop firmly within the space;

wherein the means for retaining the scoop comprises a bead formed on an inside surface of the upper skirt part, and the scoop having a handle and a tip flange at opposite ends of the scoop, the handle and tip flange defining span of a length approximately the same as the inside diameter of the upper skirt part and engaged above the bead to retain the scoop in the closure adjacent to the top panel; and wherein the bead is in the form of two opposed helical sections along the inside surface of the upper skirt part, arranged as threads with thread starts 180°-opposed, whereby the scoop can be inserted into the closure with the scoop's handle and tip flange positioned at the opposed thread starts, then screwed up into a locked position in the closure.

9. The container and closure of claim 8, wherein the upper skirt part is slightly tapered to smaller diameter toward the top panel, such that the scoop wedges tightly into the locked position as it is screwed in along the threads.

10. A container and threaded closure accompanied by a scoop for a product in the container, comprising:

a container having a generally cylindrical neck with external threads, and a container finish at a top end of the neck;

a liner adhered and sealed to the container finish thus sealing the product within the container;

a threaded closure screwed onto the threaded container neck, the closure having a generally cylindrical lower skirt part with internal threads and with a first skirt diameter, an inwardly extending annular ledge defining an upper end of the lower skirt part and positioned for engagement by the container finish with the liner, and an upper skirt part of a second diameter smaller than the first diameter, with a top panel extending across a top of the upper skirt part;

a scoop contained in the closure, in a space defined between the liner and the top panel, with means for retaining the scoop firmly within the space; and wherein the means for retaining the scoop comprises a bead formed on the inside surface of the upper skirt part, the bead being in two helical sections at 180°-opposed positions, acting as opposed helical threads, the scoop having a handle and a tip flange at opposite ends of the scoop, the handle and tip flange defining span of a length generally the same as the inside diameter of the upper skirt part, whereby the scoop can be inserted into the closure with the scoop's handle and tip flange being positioned at thread starts of the two helical threads, then the scoop can be rotated relative to the closure to effectively screw the scoop up into the upper skirt part so as to firmly retain the scoop within the closure.

11. The container and closure of claim 10, wherein the upper skirt part is slightly tapered to smaller diameter toward the top panel, such that the scoop wedges tightly into a locked position as it is screwed in along the threads.

12. A threaded closure assembly for a container, accompanied by a scoop for a product enclosed within the container, comprising:

a threaded closure having an annular skirt depending from a top panel of the closure, with internal threads formed on the skirt, and a liner positioned in the closure against an inside surface of the top panel;

an overcap of plastic, generally similar in shape to the threaded closure, the overcap having an overcap top panel and an overcap skirt depending from the overcap top panel, the overcap skirt having an annular lip of increased diameter extending down at a bottom of the skirt, the lip being fitted over the top of the threaded closure;

a scoop contained within the overcap, in a space defined between the overcap top panel and the top panel of the threaded closure when the overcap is fitted over and nested together with the threaded closure, with means for retaining the scoop in the space; and an annular shrink band extending around the overcap and threaded closure and covering a joint between the overcap and threaded closure and sealing the space within the overcap.

13. The assembly of claim 12, wherein the overcap is of substantially transparent plastic material, revealing the scoop inside.

14. The assembly of claim 12, wherein the means for retaining the scoop comprises a bead formed on the inside surface of the overcap skirt, the bead being in two helical sections at 180°-opposed positions, acting as opposed helical threads, the scoop having a having a handle and a tip flange at opposite ends of the scoop, the handle and tip flange defining span of a length generally the same as the inside diameter of the overcap skirt, whereby the scoop can be inserted into the overcap with the scoop's handle and tip flange being positioned at thread starts of the two helical threads, then the scoop can be rotated relative to the overcap to effectively screw the scoop up into the overcap so as to firmly retain the scoop within the closure.

15. The assembly of claim 12, wherein the overcap skirt is slightly tapered to smaller diameter toward the overcap top panel, such that the scoop wedges tightly into the locked position as it is screwed in along the threads.

* * * * *